United States Patent [19]
Sédat

[11] 4,455,178
[45] Jun. 19, 1984

[54] CASTABLE SMOKE GENERATING PYROTECHNIC COMPOSITION AND PROCESS FOR ITS PREPARATION

[75] Inventor: Georges Sédat, Saint-Raphael, France

[73] Assignee: Etat Francais represente par le Delegue General pour l'Armement, Paris, France

[21] Appl. No.: 512,524

[22] Filed: Jul. 11, 1983

[30] Foreign Application Priority Data

Jul. 28, 1983 [FR] France ..... 82 13157

[51] Int. Cl.[3] ..... C06B 45/10
[52] U.S. Cl. ..... 149/19.6; 149/19.1; 149/37; 149/92; 149/117
[58] Field of Search ..... 149/19.1, 19.6, 92, 149/37, 117

[56] References Cited

U.S. PATENT DOCUMENTS

| | | | |
|---|---|---|---|
| 3,198,677 | 8/1965 | Thomas | 149/19.6 |
| 3,467,558 | 9/1969 | Wernette et al. | 149/19.6 |
| 3,657,028 | 4/1972 | Pannell | 149/19.6 |
| 3,690,971 | 9/1972 | Gunderloy et al. | 149/19.6 |
| 3,733,223 | 5/1973 | Lohkamp | 149/19.6 |
| 4,025,369 | 5/1977 | Price et al. | 149/19.6 |
| 4,066,833 | 1/1978 | Nielsen | 149/18 |
| 4,186,040 | 1/1980 | Aron et al. | 149/82 |
| 4,366,010 | 12/1982 | Sédat | 149/117 |

*Primary Examiner*—Edward A. Miller
*Attorney, Agent, or Firm*—Parkhurst & Oliff

[57] ABSTRACT

A smoke generating pyrotechnic composition of the type comprising an oxidizing agent—reducing agent system, a sublimable organic dye and including a binder additionally, contains a carbazate of general formula

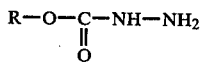

in which R represents a straight-chained or branched-chained alkyl group comprising 1 to 5 carbon atoms as cooling agent, inter alia. The composition is suitable, when the binder is a synthetic resin and includes such additional components as organic plasticizer and possibly a hardener and a metal oxide catalyst, for use in the production of cast smoke generating pyrotechnic products.

13 Claims, No Drawings

CASTABLE SMOKE GENERATING PYROTECHNIC COMPOSITION AND PROCESS FOR ITS PREPARATION

BACKGROUND OF THE INVENTION

1. Field of the Invention

This invention relates to smoke-generating pyrotechnic compositions.

A smoke-generating composition typically comprises the following constituents:

a sublimable organic dye which generates a colored smoke through its change of state, an oxidizing system a reducing system serving as binder between the oxidizing agent, the dye and catalysts which are optionally present, and which controls the speed of the reaction during its combustion, additives for example hardeners and plasticizers for the binder, wetting agent to assist the kneading of the composition, cooling agent and stabilising agent.

These constituents are generally kneaded together and the paste thus obtained is then cast in a mold so that after hardening the composition can be readily stored and handled.

The production of sufficient colored smoke will depend for a given dye, on the nature of the binder, the oxidizing agent and the additives; the choice of these additives affects the following parameters:

the minimum temperature at which the oxidizing system is operative, the maximum temperature at which the binder is stable, the maximum temperature at which the dye is stable, the possible reaction between the dye and the binder which is liable to inhibit the polymerization of the binder.

2. Description of the prior art

Numerous smoke generating pyrotechnic compositions have been proposed as a result of researches undertaken principally to improve the length of time during which smoke is emitted. Recent improvements have been contributed by U.K. Pat. No. 2,004,536 in which there is described a castable smoke generating composition comprising a synthetic resin combustible at low temperature by reaction with an oxidizing system constituted by the combination of potassium or sodium chlorate and guanidine nitrate. It was noted that the temperature for combustion or decomposition of this castable smoke generating composition was in the range of about 190° to 300° C. With combustion taking place in this way, there is obtained at this temperature a rapid sublimation of the organic dye used, which allows the retention of a particularly large portion for use at any moment in its combustion. It is also possible to use the organic dyes currently manufactured commercially without their undergoing occlusion by the residues resulting from the combustion of the composition. For more detail, reference may be made to the text of this patent.

SUMMARY OF THE INVENTION

Accordingly, it is an object of the present invention to provide smoke generating compositions of improved performance.

It is another object of the present invention to provide a smoke generating composition favoring the duration of emission of colored smoke therefrom.

Further objects will become apparent as the specification proceeds.

According to the present invention, there is provided a smoke generating pyrotechnic composition of the type which comprises an oxidizing agent—reducing agent system, sublimable organic dye and a carbazate of the general formula $$R-O-\underset{\underset{O}{\|}}{C}-NH-NH_2$$

in which R represents a straight-chained or branched alkyl group comprising from 1 to 5 carbon atoms, which composition includes a binder.

Preferably methyl, ethyl or propyl carbazate is used.

For the composition of this invention to be suitable for use in manufacture of a cast smoke generating pyrotechnic body, it preferably comprises from 10 to 25% by weight of potassium or sodium chlorate, from 10 to 30% by weight of guanidine nitrate, from 10 to 35% by weight of synthetic aliphatic epoxy resin, from 1 to 15% by weight of organic plasticizer, from 0 to 3% by weight of hardener, from 25 to 50% of a sublimable organic dye and from 0 to 5% of at least one metal oxide. Such a composition then preferably contains from 2 to 15% by weight of carbazate, calculated on the total weight of the composition.

Preferred compositions according to this invention which have been prepared are:

(a) 21% by weight of potassium or sodium chlorate, 17% by weight of guanidine nitrate, 16% by weight of resin constituted by the condensation product of epoxy propanol and of propanetriol, 35% by weight of yellow organol dye, 5% by weight of ethanediol, 3% by weight of methyl carbazate and 2% by weight of an amine hardener;

(b) 14% by weight of potassium or sodium chlorate, 24% by weight of guanidine nitrate, 38% by weight of the dye methylaminoanthraquinone, 15% by weight of resin constituted by the condensation product of epoxy propanol and propanetriol, 4% by weight of propanetriol and 5% by weight of methyl carbazate.

This invention also provides, in a second aspect, a process for the preparation of a cast smoke generating pyrotechnic composition, which comprises an oxidizing agent—reducing agent system, a sublimable organic dye and a carbazate of the general formula $$R-O-\underset{\underset{O}{\|}}{C}-NH-NH_2$$

in which R represents a straight-chained or branched alkyl group comprising from 1 to 5 carbon atoms, which composition includes a binder, which comprises dissolving the carbazate in a plasticizer optionally containing a hardener, adding the binder and further constituents of the composition, kneading the paste obtained and casting it into a mold and subjecting the paste to a temperature in the range of from 30° to 60° C. for 10 to 12 hours.

This procedure is applicable particularly to compositions containing a synthetic resin, more particularly aliphatic epoxy resin binder the compositions produced having preferably the foregoing percentage compositions.

The use of the alkyl carbazate imparts to the composition numerous advantages, among which can be indicated the following:

it acts as a cooling agent for the smoke generating composition, since, on decomposition, it generates a liberation of gas (carbon dioxide and nitrogen particularly) which assists in both the thermal protection of the organic dye and its sublimation;

the amount of residue which it leaves is minimal as a result of its high content of reactive elements such as nitrogen and oxygen;

it facilitates the thermal and oxidizing degradability of the synthetic binder; and it increases the sublimation capability of the dye of the smoke generating composition.

PREFERRED EMBODIMENTS OF THE INVENTION

The smoke generating compositions according to this invention, may contain the oxidizing system, the binder, the dyes, the hardeners and plasticizers and the various additives described in the previously mentioned Patent. Indeed, when an oxidizing system constituted by the combination of potassium or sodium chlorate and guanidine nitrate is chosen to react with a binder of the aliphatic epoxy type, the temperature for combustion of the smoke generating composition is in the range of from 190° to 300° C. at which the thermal degradation of the dye is maintained. However the combustion temperature when the chlorate alone is used is at least 400° C., and at such temperatures practically total destruction of the dye occurs; merely by using the chlorate in combination with the guanidine nitrate, this temperature drops to the range between 190° and 300° C. The guanadine nitrate thus catalizes the decomposition of the chlorate.

A binder of the aliphatic epoxy type of low molecular weight is very suitable because its combustion temperature tends to be in the range of from 180° to 300° C. The resin commercially available in France under the name "Glycidyl ether 100" may be employed for this purpose. This binder is obtained by condensation or polymerization of epoxy propanol with propanetriol. Another range of binders can be obtained by the polymerization of the glycidyl ether of 1,4-butane-diol, and can be plastized by a known organic agent of the propanediol type added before polymerization.

Insofar as the organic dye is concerned, it is sufficient that it be sublimable at a temperature at which its rate of decomposition remains weak. Put otherwise, the variation between the temperatures of sublimation and of decomposition must be as large as possible. The yellow, red, orange, green "Organol" dyes commercially available from the Company Pechiney Ugine Kuhlman can be used in the compositions of this invention. The sublimation temperature of these dyes is in the range of from 190° to 300° C.

The binder may be produced in the following manner or in equivalent manner: the carbazate which is present in the form of a crystalline solid is dissolved at about 60° C. in a liquid plasticizer (such as ethanediol or propanediol) containing possibly a hardener (such as diaminoethanol). The solution obtained is then mixed with the aliphatic epoxy resin, after cooling.

To prepare the smoke generating composition, one may proceed in the following manner: when the smoke generating composition is to contain a catalyst, the catalyst is prepared in advance by mixing different powdered metal oxides ($Fe_2O_3$, $MnO_2$, CuO, NiO etc) screened to a particle size smaller than $80\times10^{-6}$ m. This catalyst is mixed with the chlorate in a bottle. The guanidine nitrate and the dye are added in turn to the chlorate whether or not it contains the catalyst (Turbula Process). The mixture obtained is added in turn to the binder such as previously prepared and which possibly contains a hardener and kneaded for a few moments until a uniform paste is obtained.

In a variant of this procedure the chlorate (with the possible oxide catalyst) is introduced into the binder such as previously prepared and which possibly contains the hardener, followed by the guanidine nitrate then the dye.

The compositions thus prepared are then cast in cylindrical molds to form "cakes" about 10 cm high and 7.5 cm in diameter. They are initiated at an upper part thereof using a conventional ignition composition (based on silicon and copper oxide). The diameter of the smoke conducting orifice is preferably about 1.5 cm.

When a hardener is used, the hardening of the smoke generating composition commences at 30° to 35° C. and is appreciable after two hours; it is completed at the end of 10 to 12 hours. In contrast, without hardener, the hardening often requires a temperature of 60° C. and takes, during at least 12 hours to complete.

The following Examples illustrate this invention:

EXAMPLE 1

(1) Composition for yellow smoke.

0.5 Kg of smoke generating composition was prepared from the following constituents:

| | |
|---|---|
| $KClO_3$ | 21% by weight |
| guanidine nitrate | 17% by weight |
| yellow "Organol"dye | 35% by weight |
| Glycidyl ether 100 | 16% by weight |
| Plasticizer (ethanediol) | 5% by weight |
| Hardener (ethanolamine) | 2% by weight |
| Methyl carbazate | 3% by weight |

(2) Experimentation.

After manufacture of a smoke generating casting from this composition and hardening at 35° C., there is obtained, after ignition, a good regular discharge of a yellow smoke of excellent color for 8 minutes. In comparative manner, an analogous smoke generating composition containing, by weight, 21% of $KClO_3$, 18% of guanidine nitrate, 34% of yellow organol dye, 16.5% of glycidyl ether 100, 6.5% of ethanediol and 4% of ethanolamine provides an emission of yellow smoke for 3 minutes. It can thus be seen that this smoke generating composition according to the invention is of significant effect.

EXAMPLE 2

(1) Composition for red smoke.

0.5 Kg of smoke generating composition are obtained which contain the constituents:

| | |
|---|---|
| $KClO_3$ | 14% by weight |
| Guanidine nitrate | 24% by weight |
| Red "Organol"dye (methylaminoanthraquinone) | 38% by weight |
| Glycidyl ether 100 | 15% by weight |
| Plasticizer (propanediol) | 4% by weight |

-continued

| | |
|---|---|
| Methyl carbazate | 5% by weight |

(2) Experimentation.

After manufacture of a smoke generating casting and hardening at 60° C., followed by ignition, a good regular emission of a red smoke was obtained for 5 minutes.

In contrast, when the carbazate was omitted, the composition emitted a red smoke for 2 minutes.

Moreover, with the two preceding compositions, the weight of carbon residue was of the order of 1% of the initial weight, although the same compositions made up without carbazate produced a carbon residue of the order of 3 to 8% by weight.

EXAMPLE 3

(1) Composition for yellow smoke generation of long duration.

1.965 Kg of smoke generating composition was prepared containing the following constituents:

| | |
|---|---|
| $KClO_3$ | 19% by weight |
| Guanidine nitrate | 17% by weight |
| Yellow dye (Trade Mark SUDAN sold by the Company, BASF) | 35% by weight |
| Glycidyl ether 100 (binder) | 17.4% by weight |
| Plasticizer (glycerol) | 5.8% by weight |
| Hardener (ethanolamine) | 1.93% by weight |
| Methyl carbazate | 3.87% by weight |

(2) Experimentation.

A cylindrical casting was manufactured from this composition which was 7.4 cm in diameter and 41 cm long, and hardened at 35° C. On ignition of this casting a strong emission of a yellow smoke of excellent color lasting for 16 minutes was obtained.

We claim:

1. A smoke generating pyrotechnic composition which comprises an oxidizing agent—reducing agent system, a sublimable organic dye and a carbazate cooling agent of the general formula $$R-O-\underset{\underset{O}{\|}}{C}-NH-NH_2$$

in which R represents a straight-chained or branched alkyl group comprising from 1 to 5 carbon atoms, which composition includes a binder.

2. Composition according to claim 1, wherein the carbazate is selected from the group consisting of methyl, ethyl and propyl carbazate.

3. A composition according to claim 1 which comprises, by weight, 10 to 25% of an alkali metal chlorate selected from the group consisting of potassium chlorate and sodium chlorate, 10 to 30% of guanidine nitrate, 10 to 35% of synthetic aliphatic epoxy resin, 1 to 15% of organic plasticizer, 0 to 3% of hardener, 25 to 50% of a sublimable organic dye, 0 to 5% of at least one metal oxide and the carbazate.

4. Composition according to claim 3, which contains from 2 to 15% by weight of carbazate, calculated on the total weight of the composition.

5. A composition as claimed in claim 3 which contains at least one metal oxide selected from the group consisting of $Fe_2O_3$, $MnO_2$, CuO and NiO.

6. A composition as claimed in claim 3 which is in the form of a cast body.

7. A smoke generating composition according to claim 1, which is a cast body containing 21% by weight of alkali metal chlorate selected from the group consisting of potassium chlorate and sodium chlorate, 17% by weight of guanidine nitrate, 16% by weight of resin constituted by a condensation product of epoxy propanol and propanetriol, 35% of yellow organol dye, 5% by weight of ethanediol, 3% by weight of methyl carbazate and 2% by weight of an amine hardener.

8. A smoke generating composition according to claim 1, which is a cast body containing 14% by weight of alkali metal nitrate selected from the group consisting of sodium nitrate and potassium chlorate, 24% by weight of guanidine nitrate, 38% by weight of methylaminoanthraquinone, 15% by weight of resin constituted by the condensation product of epoxy propanol and propanetriol, 4% by weight of propanetriol and 5% by weight of methyl carbazate.

9. A process for the preparation of a cast smoke generating pyrotechnic composition, which comprises an oxidizing agent—reducing agent system, a sublimable organic dye and a carbazate coaling agent of the general formula $$R-O-\underset{\underset{O}{\|}}{C}-NH-NH_2$$

in which R represents a straight-chained or branched alkyl group comprising from 1 to 5 carbon atoms, which composition includes a binder, which comprises dissolving the carbazate in a plasticizer optionally containing a hardener, adding the binder and further constituents of the composition, kneading the paste obtained and casting it into a mold and subjecting the paste to a temperature in the range of from 30° to 60° C. for 10 to 12 hours.

10. A process as claimed in claim 8, wherein the binder is a synthetic resin.

11. A process as claimed in claim 9, wherein the binder is an aliphatic epoxy resin.

12. A process as claimed in claim 9, wherein a casting is produced which comprises, by weight, 10 to 25% of an alkali metal chlorate selected from the group consisting of potassium chlorate and sodium chlorate, 10 to 30% of guanidine nitrate, 10 to 35% of synthetic aliphatic epoxy resin, 1 to 15% of organic plasticizer, 0 to 3% of hardener, 25 to 50% of a sublimable organic dye, 0 to 5% of at least one metal oxide and the carbazate.

13. A process as claimed in claim 12, wherein the casting contains from 2 to 15% by weight of carbazate, calculated on the total weight of composition.

* * * * *